US005781217A

United States Patent [19]

Desie

[11] Patent Number: 5,781,217

[45] Date of Patent: Jul. 14, 1998

[54] DEVICE FOR DIRECT ELECTROSTATIC PRINTING (DEP) COMPRISING AN INTERMEDIATE IMAGE RECEIVING MEMBER

[75] Inventor: Guido Desie, Herent, Belgium

[73] Assignee: Agfa-Gevaert, N.V., Mortsel, Belgium

[21] Appl. No.: 641,689

[22] Filed: May 2, 1996

[30] Foreign Application Priority Data

May 15, 1995 [EP] European Pat. Off. ..... 95201262

[51] Int. Cl.[6] ..... B41J 2/415; B41J 2/39; B41J 2/395; B41J 2/06

[52] U.S. Cl. ..... 347/120; 347/55; 347/141; 399/154

[58] Field of Search ..... 347/128, 55, 127, 347/111, 120, 141, 159, 161, 163; 428/500; 399/154, 3, 267, 119, 120, 121, 174

[56] References Cited

U.S. PATENT DOCUMENTS

| | | | |
|---|---|---|---|
| 3,591,276 | 7/1971 | Byrne | 399/331 |
| 4,912,514 | 3/1990 | Mizutani | 399/308 |
| 5,153,618 | 10/1992 | Frank et al. | 347/125 |
| 5,214,451 | 5/1993 | Schmidlin et al. | 347/55 |
| 5,237,374 | 8/1993 | Ueno | 399/350 |
| 5,249,949 | 10/1993 | Aslam et al. | 399/328 |
| 5,262,259 | 11/1993 | Chou | 430/47 |
| 5,305,026 | 4/1994 | Kazuo | 347/55 |
| 5,353,105 | 10/1994 | Gundlach et al. | 347/103 |
| 5,512,931 | 4/1996 | Nakajima et al. | 347/213 |

*Primary Examiner*—N. Le
*Assistant Examiner*—Raquel Yvette Gordon
*Attorney, Agent, or Firm*—Baker & Botts, L.L.P.

[57] ABSTRACT

A device for direct electrostatic printing is provided wherein a flow of toner particles in a electrical field from a toner source to the surface of an intermediate image receiving member is image-wise modulated by a printhead structure with printing apertures and control electrodes, and wherein the toner image of the intermediate image receiving member is transferred to a final substrate and fixed to that final substrate. The intermediate member has a surface energy lower than 40 mN/m and surface roughness Ra smaller than 3.0 μm. The transfer of the toner image from the intermediate image receiving member to the final substrate can be aided by electrostatic attraction and/or by tackifying the toner image on the intermediate member.

20 Claims, 2 Drawing Sheets

DEVICE FOR DIRECT ELECTROSTATIC PRINTING (DEP) COMPRISING AN INTERMEDIATE IMAGE RECEIVING MEMBER

1. FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

2. BACKGROUND OF THE INVENTION

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. It is also possible to deposit the toner directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. Due to the electrical nature of said imaging process, accurate control of the distance of said printhead structure to said toner application module and said image receiving layer is very important. One of the biggest drawbacks of the DEP-process with the final substrate receiving directly said projected toner image, is the inability to print on whatever medium one has chosen as final receiving substrate.

In U.S. Pat. No. 5,305,026 a device is described comprising an intermediate recording medium upon which the toner image is jetted by using a DEP-process, after which said toner image is transferred to a final receiving member by means of an electrostatic field. The toner image is then fixed on said final receiving member. This apparatus has the advantage that images can be recorded on relatively thick recording media.

In U.S. Pat. No. 5,353,105 an apparatus for imaging on a heated intermediate member is described. In a specific embodiment a DEP-device jets a toner image upon said intermediate member that is continuously heated so that the image can be transferred to a final receiving member in a single transfusing step.

In both apparatus described above, a solution is given to the problem of printing upon various receiving members, said receiving members varying is thickness, flexibility, etc. However, the image quality, obtained on the final substrate is largely determined by the transferring or transfusing step. Therefore there is still room left for improvement in DEP devices using a transferring or transfusing step, especially in the design of said transferring or transfusing step, in order to provide a DEP system comprising an intermediate receiving member yielding images of extreme quality and sharpness, printed on various media used as final receiving members.

3. OBJECTS AND SUMMARY OF THE INVENTION

It is an object of the invention to provide an improved Direct Electrostatic Printing (DEP) device, printing with high density and high spatial resolution at a final receiving member with changing thickness, flexibility, composition, etc.

It is a further object of the invention to provide a DEP device combining said possibility of printing on various final substrates with high spatial and density resolution, with good long term stability and reliability.

Further objects and advantages of the invention will become clear from the description hereinafter.

The above objects are realized by providing a DEP device that comprises:

(i) a toner delivery means (101)

(ii) a back electrode (105)

(iii) a printhead structure (106)

(iv) an intermediate image receiving member (111) having an outermost surface (v) conveyor means (108) to convey a final image receiving member (109) over said intermediate image receiving member (111)

(vi) transfer means (112) to transfer said toner image from said intermediate image receiving member (111) to a final image receiving member (109)

(vii) means for fixing (110) said toner onto said final image receiving member, characterised in that said outermost surface of said intermediate receiving member has a surface energy lower than 40 mN/m and surface roughness Ra smaller than 3.0 μm.

4. BRIEF DESCRIPTION OF THE DRAWINGS

5. DETAILED DESCRIPTION OF THE INVENTION

Figure 1:
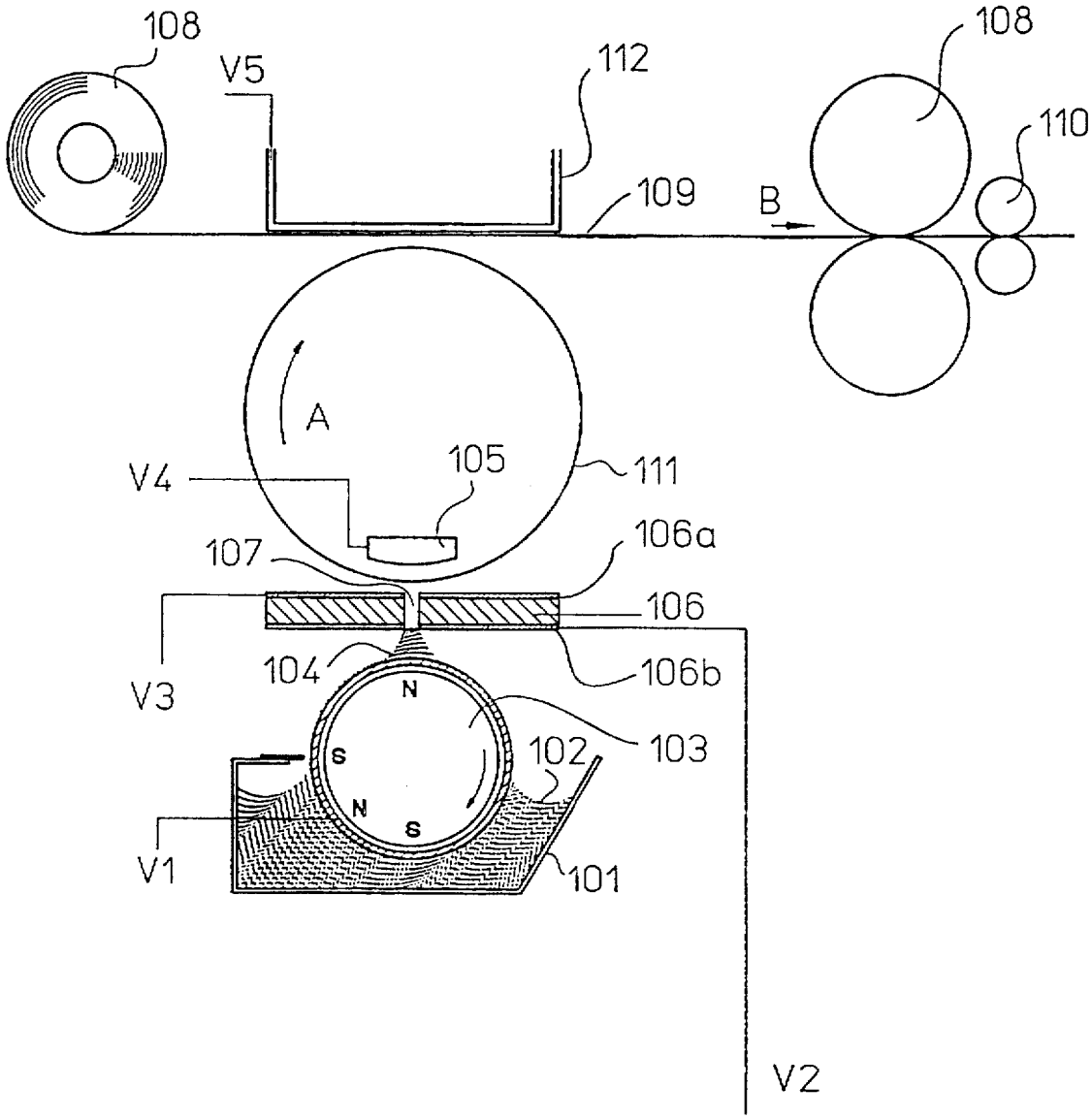
FIG. 1 is a schematic illustration of a possible embodiment of a DEP device according to the present invention.

A DEP device according to the present invention comprises an intermediate image receiving member (111) having an outer surface, wherein said outer surface has a defined maximum surface energy and a defined maximum surface roughness. By choosing the surface properties of the intermediate image receiving member it is possible to obtain a toner image with high density and image sharpness on said intermediate image receiving member. Moreover it is then possible to transfer or transfuse said toner image from said intermediate image receiving member to any final substrate while the image quality, reached on said intermediate image receiving member is conserved.

The outer surface of an intermediate image receiving member, used in a DEP device according to the present invention, has a limited surface energy, that is lower than 40 mN/m and has a limited surface roughness, that is lower than 3 μm when measured as a Ra-roughness according to ANSI/ASME B46.1-1985. Preferably said outer surface has a surface energy lower than 30 mN/m and said surface roughness lower than 2 μm and most preferably lower than 20 mN/m and said surface roughness lower than 2 μm.

Said intermediate receiving member can have any form, as long as it is possible to bring it in the neighbourhood of a printhead structure and of a final image receiving substrate. An intermediate image receiving member being a roller structure or a flexible belt offers very good possibilities to build a compact and durable DEP device, according to the present invention. An intermediate image receiving member useful in this invention, can have a rigid roller structure. Said roller structure can be made of any material having enough rigidity e.g. metal, rigid plastics etc.

When a flexible belt is used instead of a rigid roller structure, the Young modulus of elasticity is preferably larger than 2500 N/mm$^2$, and for a polymeric film the Tg value is preferentially higher than 80° C. Examples of very useful polymeric films in an intermediate image receiving member according to the present invention are polyesters, e.g. polyethyleneterephthalate, polyethylene-2-6-naphthalate, polybutyleneterephthalates, polyimide films, e.g. KAPTON (trade name of Du Pont Company, Wilmington, USA), FLEXIMID (trade name of ROGERS Corp., USA), UPILEX (trade name of Ube Corp, Japan), PYRALUX (trade name of De Pont Company, Wilmington, USA). Also stainless steel belts and metallized polymeric films, e.g. polyimide films with vacuum deposited metal layers, are useful as intermediate image bearing member in this invention. The surface energy of said intermediate image receiving member can be tuned by applying a coating on the outermost surface of it. Coating with fluoro containing polymers, e.g. coating by TEFLON, trade name of Du Pont company, Wilmington, USA for fluorocarbonpolymers as poly(tetrafluoroethylene) (PTFE) and poly (tetrafluorethylene-co-hexafluoropropylene) (FEP) or with VITOM, trade name of Du Pont company, Wilmington, USA for a fluoroelastomere of vinylidenefluoride and hexafluoropropylene) is most beneficial. Also the coating of the surface of said intermediate image bearing member of this invention with polysiloxanes is very useful. Treatment of toner bearing members with either fluorcarbonpolymers or siloxanes as been described in classical electrophotography, e.g. in U.S. Pat. No. 3,374,769 and U.S. Pat. No. 3,591,276.

A DEP device, according to the present invention, can either transfer an image from said intermediate image to a final substrate (a first embodiment) or transfuse an image from said intermediate image to a final substrate (a second embodiment).

A non limitative example of a DEP device according to a first embodiment of the present invention is shown in FIG. 1 and comprises:

(i) a toner delivery means (101), comprising a container for developer (102) and a magnetic brush (103), this magnetic brush forming a mist of charged toner particles (104)

(ii) a printhead structure (106), made from a plastic insulating film, coated on both sides with a metallic film. The printhead structure (106) comprises one continuous electrode surface, hereinafter called "shield electrode" (**106*b*) facing in the shown embodiment the toner delivering means and a complex addressable electrode structure, hereinafter called "control electrode" (106*a*) around printing apertures (107), facing, in the shown embodiment, the toner-receiving member in said DEP device. Said printing apertures are arranged in an array structure for which the total number of rows can be chosen according to the field of application. The location and/or form of the shield electrode (106*b*) and the control electrode (106*a*) can, in other embodiments of a device for a DEP method using toner particles according to the present invention, be different from the location shown in FIG. 1**.

(iii) an intermediate image receiving member (111) for said toner, having an outermost surface wherein a back electrode (105) is located, so that said outermost surface passes between said printhead structure and said back electrode, when said intermediate image receiving member is rotated in the direction of arrow A (iv) conveyor means (108) to convey a final image receiving member (109) over said intermediate image receiving member (111) in the direction indicated by arrow B.

(v) transfer means (112) to transfer said toner image on said intermediate image receiving member (111) to a final image receiving member (109)

(vi) means for fixing (110) said toner onto said final image receiving member, either by contact fusing or by radiation fusing.

Preferably said transfer means (112), in a first embodiment of the present invention, are electrostatic means.

Between said printhead structure (106) and the charged toner application module (103) as well as between the control electrode around the apertures (107) and the back electrode (105) located in the intermediate toner receiving member (111) as well as on the single electrode surface or between the plural electrode surfaces of said printhead structure (106) as well as between the intermediate image receiving member (111) and the transfer means (112) different electrical fields are applied. In the specific embodiment of a device, useful for a DEP method, using a printing device according to the present invention, shown in FIG. 1, voltage V1 is applied to the sleeve of the magnetic brush 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a timebasis or grey-level basis. Voltage V4 is applied to the back electrode behind the intermediate image receiving member 111. In other embodiments of the present invention multiple voltages $V2_0$ to $V2_n$ and/or $V4_0$ to $V4_n$ can be used. Voltage V5 is applied to the transfer means 112.

A DEP device according to the present invention, can have also a construction so that the toner is tackified on said intermediate image receiving member and is transferred to said final substrate by contacting the tackified toner image on said intermediate image receiving member with said final substrate. The toner is then released from said intermediate image receiving member and adheres to the final substrate. This is a transfusing process. The transfusing can be aided by applying pressure between the intermediate image receiving member and the final substrate, and if necessary a final heat fixing step can still be used. A DEP device according to the present invention and useful for transfusing comprises (i) a toner delivery means (101), (ii) a printhead structure (106), (iii) an array of printing apertures (107) in said printhead structure (106) through which a particle flow can be electrically modulated by a control electrode (106*a*), (iv) an intermediate image receiving member (111), having an outermost surface (v) a back electrode (105), positioned behind said intermediate image receiving member, (vi) a final image receiving member (109), (vii) heating means (113) for tackifying said toner image wherein said outermost surface of said intermediate receiving member has a surface energy lower than 40 mN/m and surface roughness Ra smaller than 3.0 μm. Preferably said heating means (113) is located outside said intermediate image receiving member (109) and said heating means is a radiative source that tackifies the toner image upon said intermediate receiving member from the toner side.

Figure 2:
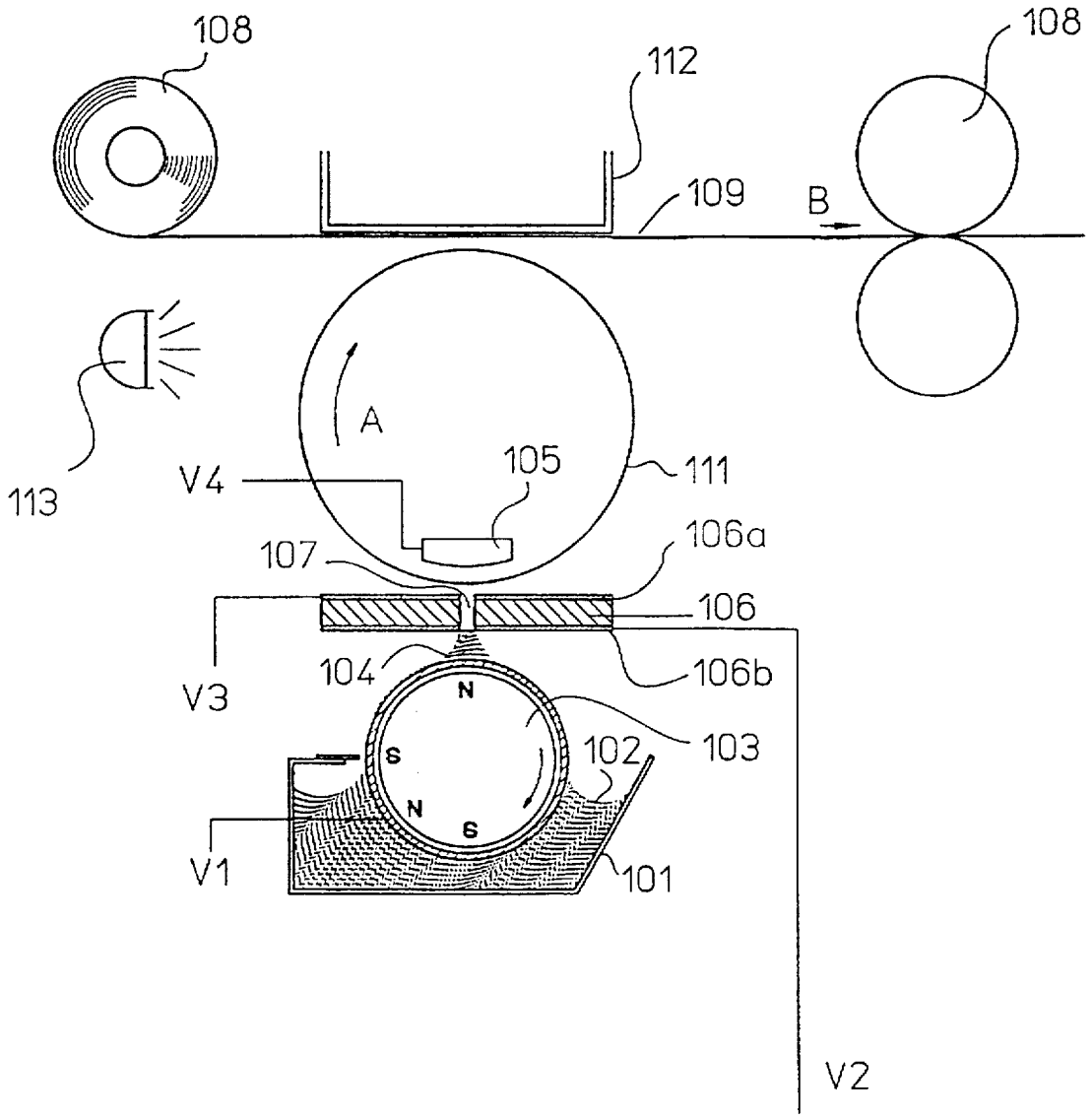
FIG. 2 is a schematic illustration of a further embodiment of a DEP device according to the present invention.

A non limitative example of a device for implementing a DEP device according to a second embodiment of the present invention is shown in FIG. 2 and comprises:

(i) a toner delivery means (101), comprising a container for developer (102) and a magnetic brush (103), this magnetic brush forming a mist of charged toner particles (104)

(ii) a printhead structure (106), made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner-receiving member in said DEP device. Said printing apertures are arranged in an array structure for which the total number of rows can be chosen according to the field of application. The location and/or form of the shield electrode (106*b*) and the control electrode (106*a*) can, in other embodiments of a device for a DEP method using toner particles according to the present invention, be different from the location shown in FIG. 2.

(iii) an intermediate image receiving member (111) for said toner, having an outermost surface wherein a back electrode (105) is located, so that said outermost surface passes between said printhead structure and said back electrode, when said intermediate image receiving member is rotated in the direction of arrow A (iv) conveyor means (108) to convey a final image receiving member (109) for said toner over said intermediate image receiving member (111) in the direction indicated by arrow B.

(v) transfusing means (112) to transfer said toner image on said intermediate image receiving member (111) to a final image receiving member (109), wherein said intermediate image receiving member (111) is heated from the toner side by a radiative power source (113) so that the toner image applied to it on one side is melt or made tacky before it reaches the final image receiving member (109), so that said toner image is transferred and fixed at the same time to said final image receiving member (i.e. the image is "transfused") by contact pressure at higher temperature.

Said intermediate image receiving member in said second embodiment of the present invention must have appropriate thermal characteristics, so that the temperature can be enhanced fast and in a reproducible way from said zone of toner application to said zone of toner transfusing so that the jumped toner image is not distorted too much after the final transfusing to said final image receiving member. Therefore, said intermediate image bearing member is characterized by a compromise between heat capacity, thermal conductivity, thickness and speed. Said compromise can very well be reached by using an intermediate image bearing member in belt form and by constructing said belt with a polymeric film that carries vacuum deposited aluminum (thickness of the aluminum layer between 100 and 2000 nm) and that has a surface coated with poly(tetrafluoroethylene). The temperature on the toner side of such a belt is enhanced by heating source (113) and ideally is brought to a low temperature again at the back electrode (105) position. Said heating source 113 can be any known heating source, e.g. a radiation source or a contact heating source. If the heating by heating source 113 is not sufficient, also transfer means 112 can be heated or the intermediate image bearing member can carry an additional internal heating source. It is possible to construct an intermediate image receiving member according to the present invention as a non-cylindrical belt as described in e.g. U.S. Pat. No. 5,103,263. Although the heating of said intermediate image receiving member, in said second embodiment of the present invention is preferentially carried out by irradiation heating from the toner side and by a radiative power source located outside of said intermediate image receiving member, said heating can also be caused by contact pressure or by irradiative heating from the back-side of said toner image.

In the specific embodiment of a device, useful for a DEP method, using a printing device according to a second embodiment of the present invention, as shown in FIG. 2, voltage V1 is applied to the sleeve of the magnetic brush 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a timebasis or gray-level basis. Voltage V4 is applied to the back electrode behind the intermediate image receiving member. In other embodiments of the present invention multiple voltages $V2_0$ to $V2_n$ and/or $V4_0$ to $V4_n$ can be used.

In FIGS. 1 and 2 a magnetic brush with carrier particles and toner particles is used as toner application module. Charged toner particles are extracted directly from said magnetic brush. In other embodiments of the present invention charged toner particles can be applied to a charged toner conveyer from which they can be extracted and propelled towards said printhead structure.

Said printhead structure is positioned between said toner application module and said intermediate receiving member. In a specific embodiment of the present invention said printhead structure is made of a plastic nonconducting material through which individual apertures are made and control electrodes positioned around said apertures are able to modify the flux of charged toner particles through said apertures. In other embodiments of this invention said printhead structure can also comprise a second conduction layer at the other surface side of said printhead structure, so that a three-layered structure is obtained: i.e. a conducting electrode layer, a nonconducting isolation layer and a second conducting electrode layer. The apertures in these printhead structures can have a constant diameter, or can have a broader entrance or exit diameter. Other possibilities of printhead structures usable in the present invention include a woven canvas structure and a hybrid structure with an isolating substrate and control electrodes on one side and a wire structure on the other side.

The back electrode (105) of a DEP device, according to the present invention, can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

When a magnetic brush is used as toner source in a DEP device according to this invention, said magnetic brush 103 is preferably of the type with stationary core and rotating sleeve.

In a DEP device, according to a preferred embodiment of the present invention, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 50 up to 250 Oe. Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 μm. The carrier particles have preferably an average volume diameter ($d_{v50}$) between 10 and 300 μm, preferably between 20 and 100 μm. More detailed descriptions of carrier particles, as mentioned above, can be found in EP-A 675 417, titled "A method and device for direct electrostatic printing (DEP)", that is incorporated herein by reference.

It is preferred to use in a DEP device according to the present invention, toner particles with an absolute average charge (|q|) corresponding to $1\ fC \leqq |q| \leqq 20\ fC$, preferably to $1\ fC \leqq |q| \leqq 10\ fC$. The absolute average charge of the toner particles is measured by an apparatus sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). From the absolute average charge per 10 μm (|q|/10 μm) the absolute average charge |q| is calculated. Moreover it is preferred that the charge distribution, measured with the apparatus cited above, is narrow, i.e. shows a distribution wherein the coefficient of variability (v), i.e. the ratio of the standard deviation to the average value, is equal to or lower than 0.33. Preferably the toner particles used in a device according to the present invention have an average volume diameter ($d_{v50}$) between 1 and 20 μm, more preferably between 3 and 15 μm. More detailed descriptions of toner particles, as mentioned above, can be found in EP-A 675 417, titled "A method and device for direct electrostatic printing (DEP)", that is incorporated herein by reference. Toner particles having as topological criterium that the ratio of the length of the long axis of the projected microscopic image of said particles to the length of the short axis is between 1.00 and 1.40 and having after addition of 0.5% by weight of fumed hydrophobic silica having a specific surface area of 260 $m^2/g$ show a ratio of apparent density ($\rho_{app}$) over real density ($\rho_{real}$) larger than 0.52, are very suitable for use in a DEP device according to the present invention. Such toners have been described in detail in European Application 94203464.6 filed on Nov. 29, 1994.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of gray levels. Gray level printing can be controlled by either an amplitude modulation of the voltage V3 applied on the control electrode 106*a* or by a time modulation of V3. By changing the duty cycle of the tin modulation at a specific frequency, it is possible to print accurately fine differences in gray levels. It is also possible to control the gray level printing by a combination of an amplitude modulation and a time modulation of the voltage V3, applied on the control electrode.

The combination of a high spatial resolution and of the multiple gray level capabilities typical for DEP, opens the way for multilevel halftoning techniques, such as e.g. described in the European patent application number 94201875.5 filed on Jun. 29, 1994 with title "Screening method for a rendering device having restricted density resolution". This enables the DEP device, according to the present invention, to render high quality images.

DEP device according to the present invention can be incorporated in monochrome printers or in colour printers. Said printers can incorporate one or more DEP device according to this invention. Especially when used in colour printers it is useful to use at least two DEP devices according to the present invention.

DEP devices according to this invention can also be combined with classical electro(photo)graphic devices to form a printer.

EXAMPLES

Throughout the printing examples, the same developer, comprising toner and carrier particles was used.

The carrier particles

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner particles

The toner used for the experiment had the following composition: 97 parts of a co-polyester resin of fumaric acid and bispropoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following formula: $(CH_3)_3N^+C_{16}H_{33}$ $Br^-$ was added in a quantity of 0.5% with respect to the binder, as described in WO 94/027192. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The average particle size was measured by Coulter Counter model Multisizer (tradename), was found to be 6.3 μm by number and 8.2 μm by volume. In order to improve the flowability of the toner mass, the toner particles were mixed with 0.5% of hydrophobic colloidal silica particles (BET-value 130 $m^2/g$)

The developer

An electrostatographic developer was prepared by mixing said mixture of toner particles and colloidal silica in a 4% ratio (w/w) with carrier particles. The triboelectric charging of the toner-carrier mixture was performed by mixing said mixture in a standard tumbling set-up for 10 min. The developer mixture was run in the magnetic brush for 5 minutes, after which the toner was sampled and the triboelectric properties were measured, according to a method as described in the above mentioned EP-A 675 417. The average charge, q, of the toner particles was −7.1 fC.

Measurement of printing quality

A printout made with a DEP device and developer described above, was judged for line-sharpness, homogeneity of the image density and toner fixing quality.

For each of the image quality properties cited above the level was expressed in plus and minus signs as follows:

++: very good

+: good

−: low

—: very low

The results are given in table 1.

EXAMPLE 1 (E1)

The printhead structure (106)

A printhead structure 106 was made from a polyimide film of 50 μm thickness, double sided coated with a 17 μm thick copper film. On the back side of the printhead structure, facing the receiving member substrate, a ring shaped control electrode 106*a* was arranged around each aperture. Each of said control electrodes was individually addressable from a high voltage power supply. On the front side of the printhead structure, facing the toner delivery means, a common shield electrode (106*b*) was present. The printhead structure 106 had six rows of apertures. The apertures had an aperture diameter of 200 μm. The width of the copper ring electrodes was 175 μm. The rows of apertures were staggered to obtain an overall resolution of 200 dpi.

For the fabrication process of the printhead structure, conventional methods of copper etching and mechanical drilling were used, as known to those skilled in the art.

The toner delivery means (101)

The toner delivery means 101 comprised a stationary core/rotating sleeve type magnetic brush (103) comprising two mixing rods and one metering roller. One rod was used to transport the developer through the unit, the other one to mix toner with developer.

The magnetic brush 103 was constituted of the so called magnetic roller, which in this case contained inside the roller assembly a stationary magnetic core, having nine magnetic poles with an open position (no magnetic poles present) to enable used developer to fall off from the magnetic roller (open position was one quarter of the perimeter and located at the position opposite to said printhead (106).

The sleeve of said magnetic brush had a diameter of 60 mm and was made of stainless steel roughened with a fine grain to assist in transport (Ra=3 3 μm) and showed an external magnetic field strength in the zone between said magnetic brush and said printhead structure of 0.045 T, measured at the outer surface of the sleeve of the magnetic brush.

A scraper blade was used to force developer to leave the magnetic roller. On the other side a doctoring blade was used to meter a small amount of developer onto the surface of said magnetic brush. The sleeve was rotating at 100 rpm, the internal elements rotating at such a speed as to conform to a good internal transport within the development unit. The magnetic brush 103 was connected to an AC power supply of 600V (3.0 kHz) with a DC-offset of −100V.

The printing engine

The distance between the front side of the printhead structure 106 and the sleeve (reference surface) of the magnetic brush 103, was set at 450 μm. The distance between the back electrode 105 of the intermediate receiving member 111 and the back side of the printhead structure 106 (i.e. control electrodes 106*a*) was set to 150 μm and said intermediate image receiving member travelled at 1 cm/sec, the final image receiving substrate travelled synchronously with said intermediate image receiving member. The shield electrode 106*b* was grounded: V2=0 V. To the individual control electrodes an (imagewise) voltage V3 between 0 V and −300 V was applied. The back electrode 105 was connected to a high voltage power supply of +600 V. To the sleeve of the magnetic brush an AC voltage of 600 V at 3.0 kHz was applied, with a DC-offset of −100V.

The intermediate image receiving member

An aluminium drum with a poly(tetrafluoroethylene) (TEFLON (trade name of Du Pont, Wilmington USA) coating was used as intermediate image receiving member. The surface coating of said intermediate image receiving member was characterised by a surface energy of 24 mN/m and a surface roughness expressed as Ra of 1.6 μm. The image was transferred to said final image receiving member (paper) by electrostatic means (+2000 V applied at the back side of said paper). After transfer the toner image was fixed by IR-irradiated power.

EXAMPLE 2 (E2)

In example 2 a print was made with the same configuration as described in example 1, but the intermediate image receiving member was made of polysiloxane with a surface energy of 19 mN/m and a surface roughness Ra of 1.9 μm.

Comparative Example 1 (CE1)

In comparative example 1 the same configuration as described in example 1 was used, but for the intermediate image receiving member no surface coating was applied to said anodized aluminum drum. The surface energy was measured to be 52 mN/m and the surface roughness was 2.8 μm.

Comparative Example 2 (CE2)

In comparative example 2 the same configuration as described in example 1 was used, but the TEFLON (trade name) coated intermediate image receiving member was roughened so that a surface roughness of 4.8 μm was obtained.

EXAMPLE 3 (E3)

In example 3 a print was made with the same configuration as described in example 1, but the intermediate image receiving member was made of aluminium with a poly (tetrafluoroethylene-co-hexafluoropropylene) (TEFLON (trade name of Du Pont, Wilmington, USA)) coating showing a surface energy of 19 mN/m and a surface roughness Ra of 1.9 μm. An IR-heater was placed at 1 quarter of the perimeter of said intermediate image receiving member in the direction towards said contact zone with the final image receiving member. The transfer means 112 was kept at 100° C., while the IR-heater was tuned so that the surface temperature of the toner layer upon said intermediate receiving member was kept between 180° and 200° C. The pressure between said intermediate image receiving member and said transfer means was set to 2N/cm.

TABLE 1

| Example | Line sharpness | Image homogeneity | Fixing quality |
|---|---|---|---|
| E1 | + | ++ | ++ |
| E2 | + | ++ | ++ |
| CE1 | – | – | — |
| CE2 | – | + | – |
| E3 | + | ++ | + |

I claim:

1. In a device for direct electrostatic printing comprising:

a back electrode having a first electrical potential;

a magnetic brush for delivering toner particles and having a surface carrying magnetic carrier particles and charged toner particles, said surface being at a second electrical potential, different from said first electrical potential, whereby a flow of charged toner particles is formed from said surface toward said back electrode;

an intermediate image receiving member having an outer surface, said member interposed between said back electrode and said magnetic brush;

means for moving said intermediate image receiving member in a first direction;

a printhead structure interposed between said intermediate image receiving member and said magnetic brush, said printhead structure having printing apertures and control electrodes for image-wise modulating said flow of toner particles and depositing a toner image on said intermediate image receiving member; and a transport for conveying a final image receiving substrate near said intermediate image receiving member and a transfer member for attracting said toner image from said intermediate image receiving member to said final image receiving substrate;

the improvement wherein said outer surface of said intermediate image-receiving member has a surface energy lower than 40 mN/m and surface roughness Ra smaller than 3.0 μm.

2. A DEP device according to claim 1, wherein said transfer member (112) comprises an electrostatic transfer member.

3. A DEP device according to claim 1, wherein said outermost surface of said intermediate image receiving member has a surface energy lower than 30 mN/m and said surface roughness is lower than 2 μm.

4. A DEP device according to claim 3, wherein said surface energy is lower than 20 mN/m.

5. A DEP device according to claim 1, wherein said intermediate image receiving member is a flexible belt.

6. A DEP device according to claim 5, wherein said flexible belt is a polymeric film having a Young modulus of elasticity larger than 2500 $N/mm^2$, and a Tg value higher than 80° C.

7. A DEP device according to claim 5, wherein said polymeric film is selected from the group consisting of a polyester film and a polyimide film.

8. A DEP device according to claim 7 wherein said polymeric film is a polyester film selected from the group consisting of a polyethyoleneterephthalate film and a polyethylene-2-6-naphthalate film.

9. A DEP device according to claim 5, wherein said flexible belt is a polymeric film comprising a vacuum deposited metal layer.

10. A colour printer comprising at least one DEP device according to claim 1.

11. In a device for direct electrostatic printing comprising:

a back electrode having a first electrical potential;

a magnetic brush for delivering toner particles having a surface carrying magnetic carrier particles and charged toner particles said surface being at a second electrical potential different from said first electrical potential, whereby a flow of charged toner particles is formed from said surface toward said back electrode;

an intermediate image receiving member having an outer surface, said member interposed between said back electrode and said magnetic brush;

means for moving said intermediate image receiving member in a first direction;

a printhead structure interposed between said intermediate image receiving member and said magnetic brush, said printhead structure having printing apertures and control electrodes for image-wise modulating said flow of toner particles and depositing a toner image on said intermediate image receiving member;

a heater, near said intermediate toner receiving member for tackifying said toner image;

a transport for conveying a final image receiving substrate near said intermediate image receiving member thereby to transfer said tackified image to said final image receiving surface; and means for fixing said toner image to said final image receiving surface, the improvement wherein, said outer surface of said intermediate image receiving member has a surface energy lower than 40 mN/m and surface roughness Ra smaller than 3.0 μm.

12. A DEP device according to claim 11, wherein said heater (103) is located outside said intermediate image receiving member and said heater is a radiative source that tackifies the toner image upon said intermediate receiving member from the toner side.

13. A DEP device according to claim 11, wherein said outermost surface of said intermediate image receiving member has a surface energy lower than 30 mN/m and said surface roughness lower than 2 μm.

14. A DEP device according to claim 13, wherein said surface energy is lower than 20 mN/m.

15. A DEP device according to claim 11, wherein said intermediate image receiving member is a flexible belt.

16. A DEP device according to claim 15, wherein said flexible belt is a polymeric film having a Young modulus of elasticity larger than 2500 $N/mm^2$, and a Tg value higher than 80° C.

17. A DEP device according to claim 15, wherein said polymeric film is selected from the group comprising a polyester film and a polyimide film.

18. A DEP device according to claim 17, wherein said polymeric film is a polyester film selected from the group comprising a polyethyoleneterephthalate film and a polyethylene-2-6-naphthalate film.

19. A DEP device according to claim 15, wherein said flexible belt is a polymeric film comprising a vacuum deposited metal layer.

20. A colour printer comprising at least one DEP device according to claim 11.

* * * * *